US009196407B2

(12) United States Patent
Bockholt et al.

(10) Patent No.: US 9,196,407 B2
(45) Date of Patent: Nov. 24, 2015

(54) WINDING DEVICE, WINDING METHOD, AND TRANSFORMER WINDING

(71) Applicant: ABB TECHNOLOGY AG, Zürich (CH)

(72) Inventors: Marcos Bockholt, Paderborn (DE); Frank Cornelius, Olsberg (DE); Burak Esenlik, Paderborn (DE); Bhavesh Patel, Brilon (DE); Jens Tepper, Brilon (DE); Benjamin Weber, Winterberg (DE)

(73) Assignee: ABB TECHNOLOGY AG, Zürich (CH)

( * ) Notice: Subject to any disclaimer, the term of this patent is extended or adjusted under 35 U.S.C. 154(b) by 74 days.

(21) Appl. No.: 14/088,004

(22) Filed: Nov. 22, 2013

(65) Prior Publication Data

US 2014/0077918 A1 Mar. 20, 2014

Related U.S. Application Data

(63) Continuation of application No. PCT/EP2012/001268, filed on Mar. 22, 2012.

(30) Foreign Application Priority Data

May 25, 2011 (EP) ..... 11004289

(51) Int. Cl.
*H01F 27/30* (2006.01)
*B21D 53/10* (2006.01)
(Continued)

(52) U.S. Cl.
CPC ..... *H01F 5/06* (2013.01); *H01F 41/062* (2013.01); *H01F 41/122* (2013.01); *H01F 41/125* (2013.01)

(58) Field of Classification Search
CPC ..... H01F 41/122
USPC ..... 336/208; 29/898.05, 898.055
See application file for complete search history.

(56) References Cited

U.S. PATENT DOCUMENTS 2,037,512 A * 4/1936 Kahlisch ..... D02H 3/00 28/195
2,257,837 A 10/1941 Burge et al.
(Continued)

FOREIGN PATENT DOCUMENTS

DE 38 15 998 A1 12/1988
GB 440 401 A 12/1935

OTHER PUBLICATIONS

International Search Report (PCT/ISA/210) mailed on Aug. 10, 2012, by the European Patent Office as the International Searching Authority for International Application No. PCT/EP2012/001268.

*Primary Examiner* — Elvin G Enad
*Assistant Examiner* — Ronald Hinson
(74) *Attorney, Agent, or Firm* — Buchanan Ingersoll & Rooney PC

(57) ABSTRACT

A transformer winding device, a method and a transformer are disclosed. The transformer winding winding device includes a rotary device configured to extend along an axis of rotation and configured to receive a transformer winding to be wound, at least one device configured to provide a plurality of insulation strips, and a comb-like guide device. The comb-like device is configured to deflect the plurality of insulation strips into at least one common winding plane and fed parallel to one another, at an angle to an axis of rotation, to the transformer winding to be wound. The comb-like guide device can include at least a first guide device element for a first group of insulation strips and a second guide device element for a second group of insulation strips, wherein the first and second guide device elements are offset with respect to one another in terms of axial length.

20 Claims, 3 Drawing Sheets

(51) Int. Cl.

| | |
|---|---|
| ***B21D 53/00*** | (2006.01) |
| ***H01F 5/06*** | (2006.01) |
| ***H01F 41/06*** | (2006.01) |
| ***H01F 41/12*** | (2006.01) |

(56) References Cited

U.S. PATENT DOCUMENTS 3,378,626 A * 4/1968 Tucker ..... H01F 27/324 174/117 R
3,866,316 A 2/1975 Takechi et al.
4,288,485 A * 9/1981 Suominen ..... A47H 23/00 156/193
4,870,742 A * 10/1989 Roloff ..... B21F 3/04 140/92.2
4,878,628 A 11/1989 Takeda et al.
5,560,103 A * 10/1996 Harris ..... B29C 53/586 156/154
6,221,297 B1 4/2001 Lanoue et al.
7,314,195 B2 * 1/2008 Takeda ..... H01F 41/0633 242/445.1
2004/0251998 A1 * 12/2004 Radford ..... H01F 41/0608 336/90

* cited by examiner

PRIOR ART

90

WINDING DEVICE, WINDING METHOD, AND TRANSFORMER WINDING

RELATED APPLICATION

This application claims priority as a continuation application under 35 U.S.C. §120 to PCT/EP2012/001268, which was filed as an International Application on Mar. 22, 2012, designating the U.S., and which claims priority to European Application No. 11004289.2 filed on May 25, 2011. The entire contents of these applications are hereby incorporated by reference in their entireties.

FIELD

The disclosure relates to a transformer winding winding device, including a rotary device extending along an axis of rotation for receiving a transformer winding to be wound, at least one device for providing a plurality of identical insulation strips, a comb-like guide device with which the provided insulation strips can be deflected into at least one common winding plane and can be fed from there, parallel to one another, at an angle to the axis of rotation, to the transformer winding to be wound.

BACKGROUND INFORMATION

Dry-type transformers, for example, can have power ranges from a few 100 kVA to a few 10 MVA and higher, and can have voltages in the range of from 6 kV up to a few 10 kV. In contrast to oil-type transformers, in which the transformer can be arranged in an oil-filled tank, whereby the insulating clearances can be correspondingly reduced, in the case of a dry-type transformer correspondingly increased complexity for the insulation can be involved.

It is known that insulation layers between different winding layers can be used in the manufacture of transformer windings, for example, for dry-type transformers, in order to increase the voltage loading capacity of such a winding. The insulation layers can be produced from a wound insulation strip, for example a resin-impregnated fiber or glass fiber roving. This can be applied by means of the same winding device which can also be used for winding the electrical conductor on a coil former. Depending on the specifications placed on the insulation layer to be manufactured, a winding operation of conductor and insulation strip can be performed sequentially or synchronously.

The insulation strip can be provided in small widths, for example 5 mm, on corresponding rollers, wherein in each case a plurality of, for example 12, 16 or 24, such strips can be wound in parallel, with the result that, in the mentioned example, an effective winding width of 6 cm, 8 cm or 12 cm would result. The use of such narrow strips instead of a single insulation strip with a greater width can be used because the insulation strips can be moved back and forth along the winding axis in an oscillatory movement during the winding operation. For example, at the turning points in the movement, an excessively wide width of the insulation strip can result in the formation of folds, for example, as a result of which the insulation capacity of the wound insulation layer can be negatively influenced.

In order to enable guidance of the individual insulation strips in a manner which is relatively parallel with respect to the winding device and therefore as relatively seamless an application as a homogeneous winding layer, the individual strips can be guided by a guide device, for example, a so-called winding comb. This can have prongs which are relatively thin, by means of which the respective insulation strips can be guided. Since the insulation strips running next to one another can be intended to form a homogenous and seamless layer, for reasons of insulation, however, the insulation strips can be bent on passage through the winding comb owing to the width of the respective prongs.

The bending can be predominantly maintained during the advancing movement of the insulation strip from the winding comb up to the surface, with the result that adjacent insulation strips cannot abut one another in impact-free fashion. As a result, the insulation capacity of the wound insulation layer can be negatively influenced, which can be compensated for by a correspondingly greater layer thickness.

The disclosure discloses a device for winding a transformer winding, which can include a transformer winding with a wound intermediate insulation layer which is relatively homogenous.

SUMMARY

A transformer winding device is disclosed, comprising: a rotary device configured to extend along an axis of rotation and configured to receive a transformer winding to be wound; at least one device configured to provide a plurality of insulation strips; and a comb-like guide device configured to deflect the plurality of insulation strips into at least one common winding plane to be fed parallel to one another, at an angle to an axis of rotation, to the transformer winding to be wound, wherein the comb-like guide device includes at least a first guide device element for a first group of insulation strips and a second guide device element for a second group of insulation strips, wherein the first and second guide device elements are offset with respect to one another in terms of axial length, and wherein the first and second groups are combined on the transformer winding to form a homogeneous layer, wherein a respective insulation strip in the first group is configured to be inserted into an interspace between two adjacent insulation strips in the second group.

A method of winding a transformer winding is disclosed, the method comprising: providing a rotary device configured to extend along an axis of rotation and configured to receive a transformer winding to be wound; providing a plurality of insulation strips; deflecting the plurality of insulation strips into at least one common winding plane to be fed parallel to one another, at an angle to an axis of rotation, to the transformer winding to be wound with a comb-like guide device, wherein the comb-like guide device includes at least a first guide device element for a first group of insulation strips and a second guide device element for a second group of insulation strips, wherein the first and second guide device elements are offset with respect to one another in terms of axial length; and combining the first and second groups on the transformer winding to form a homogeneous layer, wherein a respective insulation strip in the first group is configured to be inserted into an interspace between two adjacent insulation strips in the second group.

A transformer winding is disclosed, the winding comprising: a transformer body having a plurality of insulating strips wound around the body by: providing a rotary device configured to extend along an axis of rotation and configured to receive the transformer body to be wound; providing the plurality of insulation strips; deflecting the plurality of insulation strips into at least one common winding plane to be fed parallel to one another, at an angle to an axis of rotation, to the transformer winding to be wound with a comb-like guide device, and wherein the comb-like guide device includes at least a first guide device element for a first group of insulation strips and a second guide device element for a second group of insulation strips, wherein the first and second guide device elements are offset with respect to one another in terms of axial length; and combining the first and second groups on the transformer winding to form a homogeneous layer, wherein a respective insulation strip in the first group is configured to be inserted into an interspace between two adjacent insulation strips in the second group.

BRIEF DESCRIPTION OF THE DRAWINGS

In the following, exemplary embodiments, will be described in greater detail by reference to the attached drawings, in which.

DETAILED DESCRIPTION

Figure 1:
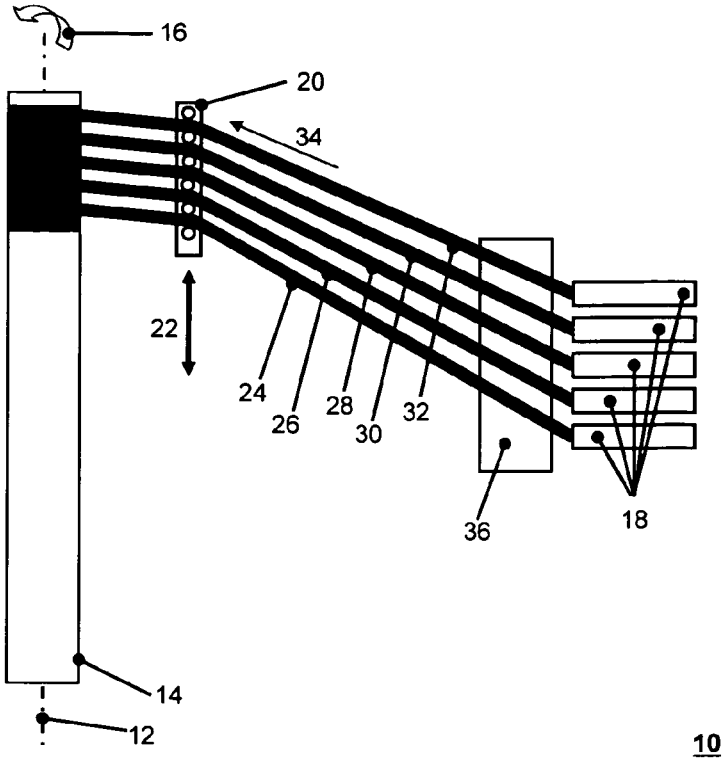
FIG. 1 shows a first partial view of an exemplary transformer winding winding device.

The disclosure related to a transformer winding winding device, which can include a the comb-like guide device, which can include at least a first guide device element for a first group of insulation strips and a second guide device element for a second group of insulation strips, wherein the guide device elements are offset with respect to one another in terms of axial length.

The term transformer winding can be interpreted here in a broad meaning and, in addition to transformer windings, in the actual sense with a high-voltage winding and/or a low-voltage winding, also can also include electrical coils or inductors with a comparable order of magnitude.

By guidance of the insulation strips by two different guide device elements which are offset with respect to one another, the insulation strips which can be guided next to one another, do not adjoin one another directly in parallel and deformed, as a result of the width of the prongs of a guide comb. Since the insulation strips can be guided in a first and a second part alternately by two different, likewise comb-like guide device elements, the respective prongs or prong-like spacer elements can be designed to be wider, wherein the interspace formed between the prong-like spacer elements, which interspace can be used for guiding a respective insulation strip, which can have at least the width of a respective insulation strip, with the result that deformation of the insulation strip can be avoided.

The first and second parts of the insulation strips therefore each have an alignment parallel to one another but spaced apart from one another during the winding process after passage through the guide device elements, wherein each of the two groups of insulation strips is in a respective plane. For example, both planes can intersect one another on the surface of the rotating transformer winding to which the insulation strips can be fed during the winding process. According to the disclosure, both groups can be combined there to form a homogenous layer by virtue of a respective insulation strip in the first group being introduced precisely into an interspace between two adjacent insulation strips in the second group. For example, the respective widths of the insulation strips, the respective clearances between adjacent insulation strips and the offset of the two groups of insulation strips with respect to one another, which can be determined by the offset of the guide device elements with respect to one another, can be matched to one another.

Corresponding to an exemplary embodiment of the disclosure, the first comb-like guide device and the second comb-like guide device each can have prong-like spacer elements, whose width corresponds to the width of the guide slots formed respectively between them. In an exemplary embodiment, the first comb-like guide device and the second comb-like guide device can each be offset with respect to one another through precisely one guide slot width. For example, in this case the width of the guide slots can be matched to the width of the provided insulation strips. By virtue of the above-mentioned matching measures, the winding of an insulation layer which is as homogenous as possible can be improved.

In accordance with an exemplary embodiment, the transformer winding winding device can include an impregnation device, for example, a resin impregnation device, for impregnating the provided insulation strips. Impregnation of insulation strips, for example with an epoxy resin, can be used during the further manufacture of an insulation layer of a transformer winding for subsequent solidification of the insulation layer. Insulation strips can be delivered dry and on coil formers for storage-related and manufacturing-related reasons. A suitable insulation strip material can be, for example, a fiber or glass roving. For example, if the insulation strip material is impregnated with a resin during the winding operation on the feed path from the respective coil former to the winding body, the wound insulation layer can be impregnated with the resin. In a subsequent curing process, for example at a temperature of 160° C., depending on the impregnation material used, also significantly below this value in the case of a two-component material, the insulation layer can then be solidified.

A resin-filled basin through which the insulation strips are guided can be used as impregnation device, for example. Corresponding further variants of impregnation devices are known to a person skilled in the art.

In accordance with an exemplary embodiment of a transformer winding winding device according to the disclosure, the transformer winding winding device can also include devices for providing and for winding an electrical conductor. In accordance with an exemplary embodiment, an electrical conductor can be provided on rollers or coils, but can also be applied to the winding body as a single conductor in layers. For example, a copper or aluminum conductor, which can be surrounded by a layer of insulating enamel, can be used as the single conductor. The guidance of an electrical conductor during the winding operation can be performed, for example, by a winding carriage, which can be movable or moved in a similar manner to a guide device for insulation strips, for example in an oscillatory movement along the winding axis. The use of a plurality of parallel conductors which are wound simultaneously can be likewise used.

In accordance with an exemplary embodiment, a transformer winding winding device according to the disclosure can be developed in such a way that synchronous winding of insulation strips and the electrical conductor can be performed. For example, the feed of the insulation strips and the feed of the winding conductor are such that they do not impede one another. In accordance with an exemplary embodiment, the feed device for the insulation strips and the winding carriage for the winding conductor can be configured such that they can perform oscillatory movements independently of one another.

In accordance with an exemplary embodiment of the transformer winding winding device, the first guide device element and the second guide device element can be formed by a double winding comb. The winding comb can have, for example, an elongate central element, wherein spacer elements can be arranged emerging from the central element towards two sides in a respective plane at equidistant distances from one another. For example, the two guide device elements can be integrated to form a single element, which can also be relatively easy to manufacture, for example by means of milling or laser cutting from a metal plate. In addition, in this case a discrepancy in the offset of the guide device elements with respect to one another can be ruled out.

In accordance with an exemplary embodiment of the disclosure, the guide device can be adjustable in such a way that the feed angle of the provided insulation strips can be adaptable. For example, a feed angle of 0° in this case can correspond to an alignment perpendicular to the winding axis. In accordance with an exemplary embodiment, a slight adjustment of the angle, for example in a range of from about 10° to 20°, can result in the individual parallel insulation strips, for example 24, not hitting the winding body simultaneously but with a slight time offset with respect to one another. For example, as a result, the winding response or the operation of them being inserted one inside the other can be further improved. In accordance with an exemplary embodiment, the disclosure can provide for the guide device to be movable along the axis of rotation and for example, and also for implementing oscillatory movements. For example, as a result, variable winding lengths can be produced in a simple manner. In accordance with an exemplary embodiment, if appropriate, the above-described setting angle of the oscillation direction of the guide device can be adapted.

In accordance with an exemplary embodiment, a transformer winding can be manufactured using a transformer winding winding device according to the disclosure. For example, by virtue of the adjacent insulation strips being fed in an alternating manner which can be matched geometrically during manufacture by means of the first and second guide device elements, the transformer winding according to the disclosure can have, for example, a homogeneous insulation layer formed from the wound insulation strips. The insulation layer can then be designed to be correspondingly thinner owing to its thus increased dielectric strength.

In accordance with an exemplary embodiment, a transformer winding winding device can also be used for winding tubular hollow bodies. For example, a winding body with the desired cross section can be used instead of a coil former. The layer of insulation strips which can, for example, be impregnated with resin which can be wound during the winding operation then forms the wall of the hollow body after a corresponding curing process.

FIG. 1 shows a first partial view 10 of an exemplary transformer winding winding device. A rotating device 14 can be arranged around a winding axis 12. For example, a winding body which is rotatable in regulated fashion by means of a drive device and on which a few winding layers of an electrical conductor having already been wound, but this is not shown in the drawing. The illustrated intermediate manufacturing state of the winding represents, inter alia, a partially manufactured wound intermediate insulation layer, which is illustrated in black.

This intermediate insulation layer can be formed from a first group of insulation strips 24, 26, 28, 30, 32, which can be wound around the rotating device 14 or the winding body located thereon. The insulation strips 24, 26, 28, 30, 32 can be provided by the first provision devices 18, for example coils, and fed in the feed direction 34 to a first guide device element 20. By virtue of the comb-like design of the guide device element, the insulation strips 24, 26, 28, 30, 32 can be brought into a parallel position with an equidistant clearance with respect to one another and are then guided approximately at an angle perpendicular to the winding axis 12 onto the winding body.

During the winding process, the rotating device 14 can be rotated in the direction of the arrow 16, with the result that the insulation strips 24, 26, 28, 30, 32 are wound on the winding body. In accordance with an exemplary embodiment, the first guide device element can be capable of oscillating in the arrow direction 22 along the axial extent of the rotating device, with the result that a wound insulation layer can thus be produced over the entire axial winding length. The reference numeral 36 denotes a resin impregnation device, by means of which the insulation strips 24, 26, 28, 30, 32, for example glass fiber rovings, can be impregnated with a resin as they are fed during the winding process.

Figure 2:
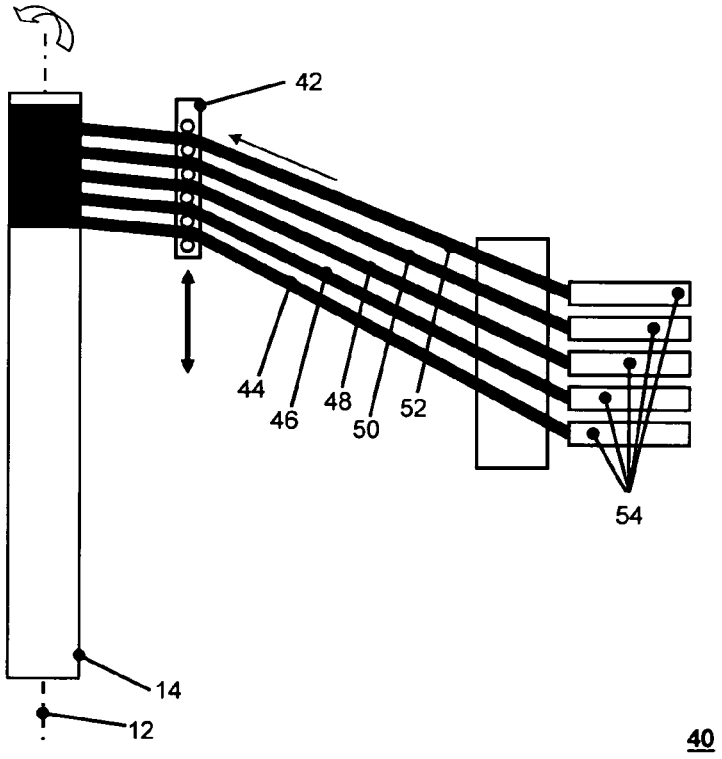
FIG. 2 shows a second partial view of the exemplary transformer winding winding device of FIG. 1.

FIG. 2 shows a second partial view 40 of the same exemplary transformer winding winding device. In contrast to the first partial view shown in FIG. 1, in this case a second group of insulation strips 44, 46, 48, 50, 52 is shown, which can be guided via a second comb-like guide device element 42, wherein the insulation strips in this case can be made available by a second provision device 54. The first partial view 10 and the second partial view 40 of the transformer winding winding device can be produced by an additive combination of the essential components thereof. For example, the first group of insulation strips 24, 26, 28, 30, 32 and the second group of insulation strips 44, 46, 48, 50, 52, when they meet the winding device 14 or the winding body, can be joined to form a virtually seamless strip, from which the wound insulation layer can be formed, which can increase the insulation capacity of the insulation layer.

Figure 3:
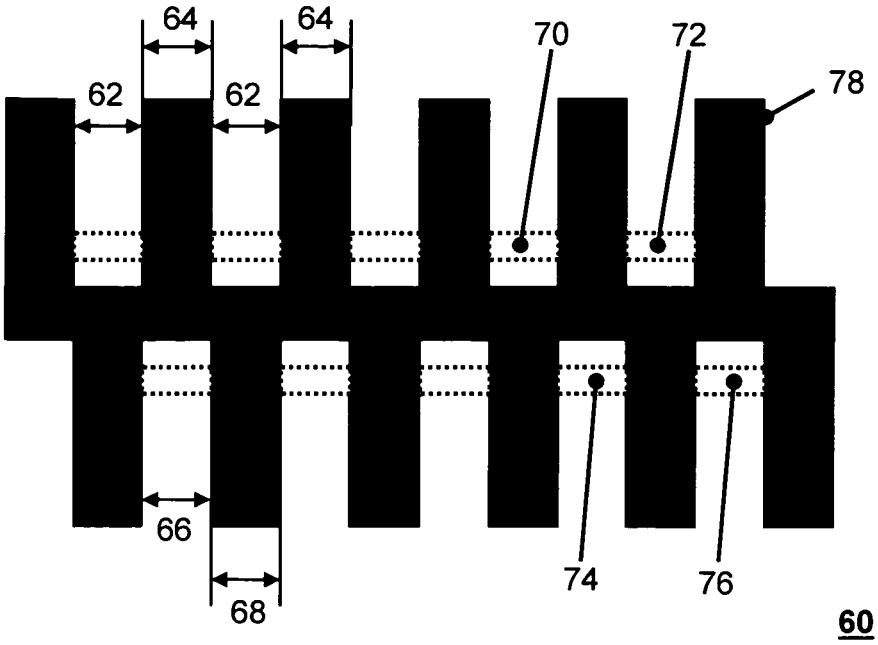
FIG. 3 shows an exemplary first comb-like guide device according to the disclosure.

FIG. 3 shows a first comb-like guide device 60 according to the disclosure. The guide device can have two opposite comb-like guide devices which are offset with respect to one another, for example, a first guide device element and a second guide device element according to the disclosure. The guide devices can be formed substantially from prong-like spacer elements 78, which can be arranged next to one another with an equidistant clearance, wherein the width 64 of all of the upper prong-like spacer elements 78 corresponds precisely to the width 62 of the upper guide slots formed therebetween. The width 68 of the lower prong-like spacer elements 78 likewise corresponds to the width 66 of the lower guide slots formed therebetween, for example 5 mm. In accordance with an exemplary embodiment, each of the guide slots and prong-like spacer elements 78 can have the same width and can be offset with respect to one another through this width. The upper insulation strips 70, 72 indicated by dashed lines and the lower insulation strips 74, 76 can be matched to the width of the respective guide slots and can in each case be identical. In accordance with an exemplary embodiment, for example, due to the offset of the upper and lower guide slots with respect to one another through one insulation strip width, the insulation strips can be aligned once they have passed through the comb-like guide device, in such a way that they adjoin one another virtually seamlessly during winding on the surface of a winding body.

Figure 4:
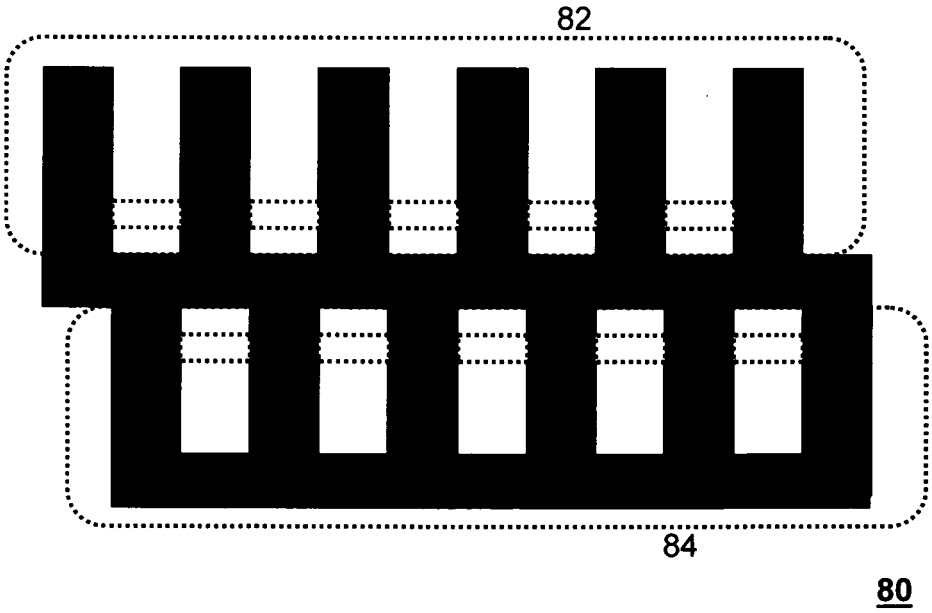
FIG. 4 shows an exemplary second comb-like guide device according to the disclosure.

FIG. 4 shows a second comb-like guide device 80 according to the disclosure which substantially corresponds to the first device 60. In contrast to this, relevant regions 82, 84 are illustrated by dashed lines, which relevant regions form a respective first or second guide device element. The lower guide device element can also have a terminating web at its outer end, which terminating web can prevent an insulation strip guided in the guide device element from sliding out, as a result of the force of gravity, for example, during the feed operation.

Figure 5:
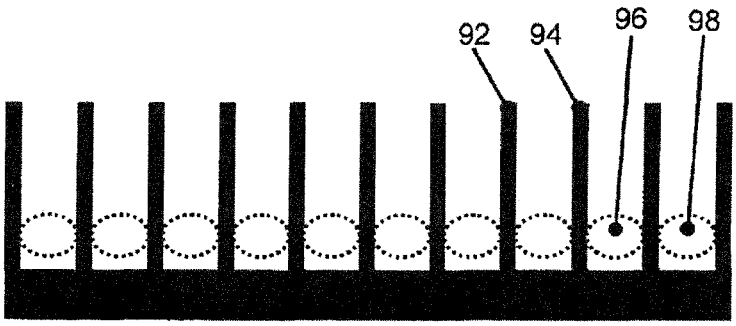
FIG. 5 shows a known guide device.

FIG. 5 shows a known winding comb 90. Guide slots are formed between prongs 92, 94, with insulation strips 96, 98 being guided within the guide slots. The width of the guide slots is a prong width smaller than the width of a flat insulation strip. Therefore, the insulation strips guided between the prongs 96, 98 are illustrated slightly bent. Such bending is substantially still retained as the insulation strips 96, 98 are fed further to the winding body, which ultimately has a negative effect on the insulation capacity of an insulation layer wound accordingly, with the result that this insulation layer would need to be wound more thickly with a comparable insulation capacity.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 First partial view of exemplary transformer winding winding device
12 Axis of rotation
14 Rotary device
16 Direction of rotation of rotary device
18 First devices for providing insulation strips
20 First guide device element
22 Movement direction of first guide device element
24 First insulation strip
26 Second insulation strip
28 Third insulation strip
30 Fourth insulation strip
32 Fifth insulation strip
34 Feed direction of insulation strip
36 Resin impregnation device
40 Second partial view of exemplary transformer winding winding device
42 Second guide device element
44 Sixth insulation strip
46 Seventh insulation strip
48 Eighth insulation strip
50 Ninth insulation strip
52 Tenth insulation strip
54 Second devices for providing insulation strips
60 First comb-like guide device
62 Width of guide slot of first guide device element
64 Width of prong-like spacer element of first guide device element
66 Width of guide slot of second guide device element
68 Width of prong-like spacer element of second guide device element
70 Eleventh insulation strip
72 Twelfth insulation strip
74 Thirteenth insulation strip
76 Fourteenth insulation strip
78 Prong-like spacer element
80 Second comb-like guide device
82 First guide device element
84 Second guide device element
90 Guide device corresponding to prior art
92 First prong
94 Second prong
96 First buckled insulation strip
96 Second buckled insulation strip

What is claimed is:

1. A transformer winding winding device, comprising:

a rotary device configured to extend along an axis of rotation and configured to receive a transformer winding to be wound;

at least one device configured to provide a plurality of insulation strips; and a comb-like guide device configured to deflect the plurality of insulation strips into at least one common winding plane to be fed parallel to one another, at an angle to an axis of rotation, to the transformer winding to be wound, wherein the comb-like guide device includes at least a first guide device element for a first group of insulation strips and a second guide device element for a second group of insulation strips, wherein the first and second guide device elements are offset with respect to one another in terms of axial length, and wherein the first and second groups are combined on the transformer winding to form a homogeneous layer, wherein a respective insulation strip in the first group is configured to be inserted into an interspace between two adjacent insulation strips in the second group.

2. The transformer winding winding device as claimed in claim 1, wherein each of the plurality of insulation strips is identical.

3. The transformer winding winding device as claimed in claim 1, wherein the first comb-like guide device and the second comb-like guide device each have prong-like spacer elements, whose width corresponds to a width of guide slots formed respectively between the prong-like spacer elements.

4. The transformer winding winding device as claimed in claim 3, wherein the first comb-like guide device and the second comb-like guide device are each offset with respect to one another by one guide slot width.

5. The transformer winding winding device as claimed in claim 3, wherein the width of the guide slots is equal to a width of the insulation strips.

6. The transformer winding winding device as claimed in claim 1, wherein the transformer winding winding device comprises:

an impregnation device for the plurality of insulation strips.

7. The transformer winding winding device as claimed in claim 5, wherein the impregnation device is a resin impregnation device.

8. The transformer winding winding device as claimed in claim 1, wherein the transformer winding winding device comprises:

devices for providing and winding an electrical conductor.

9. The transformer winding winding device as claimed in claim 8, wherein the transformer winding winding device is configured to provide synchronous winding of the plurality of insulation strips and the electrical conductor.

10. The transformer winding winding device as claimed in claim 1, wherein the first guide device element and the second guide device element are formed by a double winding comb.

11. The transformer winding winding device as claimed in claim 1, wherein the guide device is adjustable such that a feed angle of the plurality of insulation strips is adaptable.

12. The transformer winding winding device as claimed in claim 1, wherein the guide device is movable along the axis of rotation.

13. The transformer winding winding device as claimed in claim 1, comprising:

at least one hollow body.

14. A method of winding a transformer winding, the method comprising:

providing a rotary device configured to extend along an axis of rotation and configured to receive a transformer winding to be wound;

providing a plurality of insulation strips;

deflecting the plurality of insulation strips into at least one common winding plane to be fed parallel to one another, at an angle to an axis of rotation, to the transformer winding to be wound with a comb-like guide device, wherein the comb-like guide device includes at least a first guide device element for a first group of insulation strips and a second guide device element for a second group of insulation strips, wherein the first and second guide device elements are offset with respect to one another in terms of axial length; and combining the first and second groups on the transformer winding to form a homogeneous layer, wherein a respective insulation strip in the first group is configured to be inserted into an interspace between two adjacent insulation strips in the second group.

15. The method of winding a transformer winding as claimed in claim 14, wherein each of the plurality of insulation strips is identical.

16. The method of winding a transformer winding as claimed in claim 14, wherein the first comb-like guide device and the second comb-like guide device each have prong-like spacer elements, whose width corresponds to a width of guide slots formed respectively between the prong-like spacer elements.

17. The method of winding a transformer winding as claimed in claim 14, wherein the first comb-like guide device and the second comb-like guide device are each offset with respect to one another by one guide slot width.

18. The method of winding a transformer winding as claimed in claim 17, wherein the width of the guide slots is equal to a width of the insulation strips.

19. A transformer winding, the winding comprising:

a transformer body having a plurality of insulating strips wound around the body by:

providing a rotary device configured to extend along an axis of rotation and configured to receive the transformer body to be wound;

providing the plurality of insulation strips;

deflecting the plurality of insulation strips into at least one common winding plane to be fed parallel to one another, at an angle to an axis of rotation, to the transformer winding to be wound with a comb-like guide device, and wherein the comb-like guide device includes at least a first guide device element for a first group of insulation strips and a second guide device element for a second group of insulation strips, wherein the first and second guide device elements are offset with respect to one another in terms of axial length; and combining the first and second groups on the transformer winding to form a homogeneous layer, wherein a respective insulation strip in the first group is configured to be inserted into an interspace between two adjacent insulation strips in the second group.

20. The transformer winding as claimed in claim 19, wherein transformer winding has a geometrically matched and alternating feed of adjacent insulation strips by the first guide device element and the second guide device element, and a homogenous insulation layer formed from the wound insulation strips.

* * * * *